United States Patent [19]

Jatich

[11] 4,183,167

[45] Jan. 15, 1980

[54] THREE DIMENSIONAL TOY

[76] Inventor: Michael Jatich, 2127 Tyrone St., Akron, Ohio 44312

[21] Appl. No.: 885,451

[22] Filed: Mar. 10, 1978

[51] Int. Cl.[2] ..... A63H 33/08

[52] U.S. Cl. ..... 46/16; 46/25; 46/31

[58] Field of Search ..... 46/16, 17, 23–31

[56] References Cited

U.S. PATENT DOCUMENTS

| | | | |
|---|---|---|---|
| 510,178 | 12/1893 | Konig | 35/27 |
| 2,611,193 | 9/1952 | Davis | 35/31 |
| 2,759,295 | 8/1956 | Keuls | 46/16 |
| 3,302,311 | 2/1967 | Israel | 35/69 |
| 3,487,579 | 1/1970 | Brettingen | 46/25 |
| 3,570,170 | 3/1971 | Kishi | 46/25 |
| 3,579,859 | 3/1971 | Malenge | 35/27 |
| 3,748,752 | 7/1973 | Quercetti | 46/16 X |
| 3,766,667 | 10/1973 | Glassman | 46/26 X |
| 3,849,912 | 11/1974 | Kemnitzer | 46/16 X |
| 4,051,621 | 10/1977 | Hogan | 46/26 |

FOREIGN PATENT DOCUMENTS

| | | | |
|---|---|---|---|
| 184497 | 1/1956 | Austria | 46/26 |
| 2414246 | 10/1975 | Fed. Rep. of Germany | 46/16 |
| 935308 | 8/1963 | United Kingdom | 46/25 |

*Primary Examiner*—John F. Pitrelli

*Attorney, Agent, or Firm*—Reese Taylor

[57] ABSTRACT

A three dimensional, educational and entertainment toy or game is disclosed. The game includes a board having a plurality of rows of pegs of preferrably hexagonal cross-section projecting from the top surface thereof and arranged with the pegs of alternate rows being offset from each other so that pegs in one row are disposed on a line halfway between those of the next adjacent row. Thus a line drawn from the midpoint of any three immediately adjacent pegs will form an equilateral triangle where two of the pegs lie in one row and the remaining peg lies on a line splitting the distance between the first two. The game also includes a plurality of geometrically shaped playing pieces taking various planar forms such as equilateral triangles, regular hexagonals, squares, circles etc. and being cast in varying colors so that an almost infinite variety of geometric and color configurations can be achieved when the pieces are assembled on the board. Each of the geometrically shaped playing pieces also includes a centrally located recess in its bottom surface and a centrally located projection in its top surface with the projections having cross-sectional configurations complemental to that of the pegs and being sized so as to fit easily into the recesses and with the recesses also being sized so as to fit easily over the pegs on the board.

3 Claims, 9 Drawing Figures

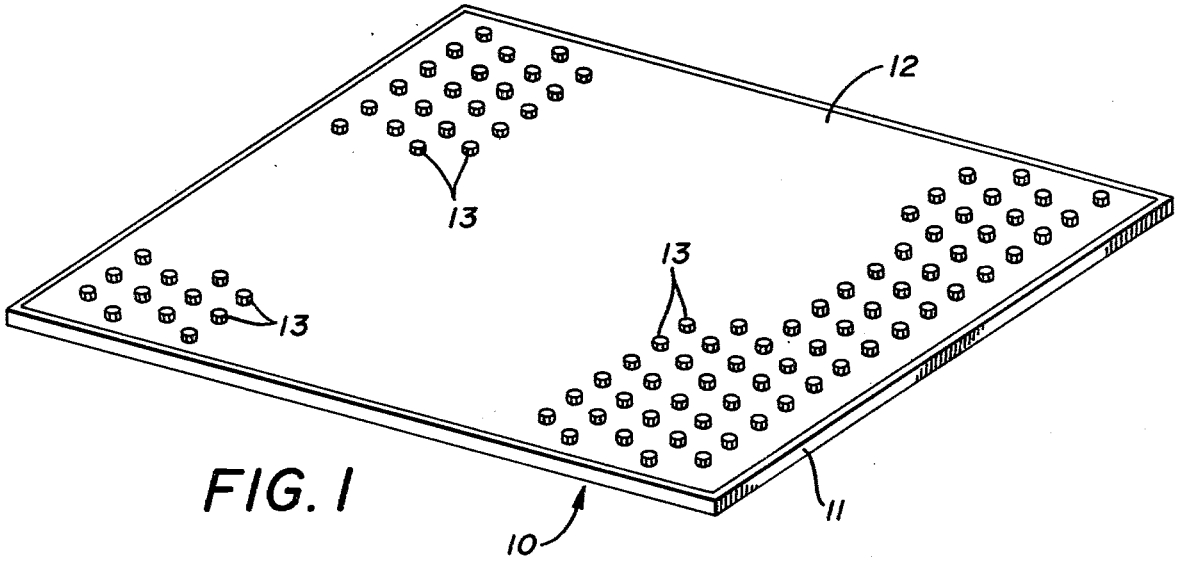
FIG. 1
FIG. 2
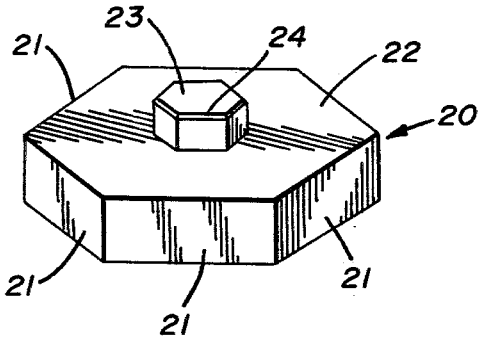
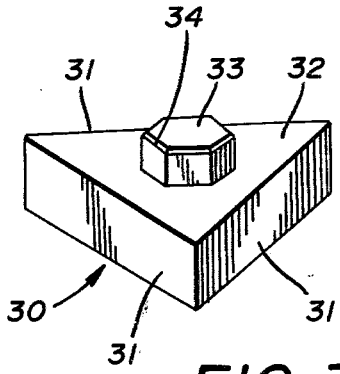
FIG. 3
FIG. 5
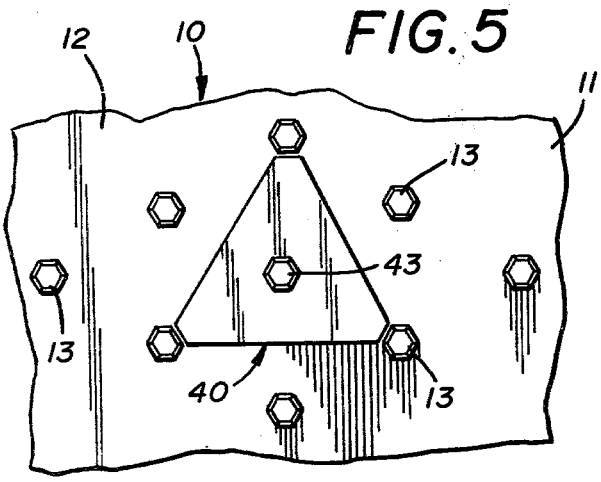
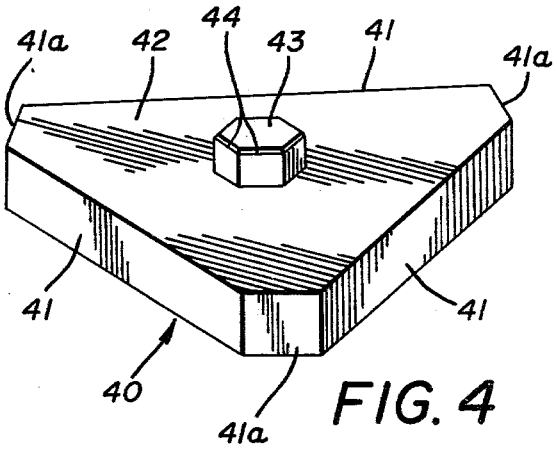
FIG. 4

FIG. 7
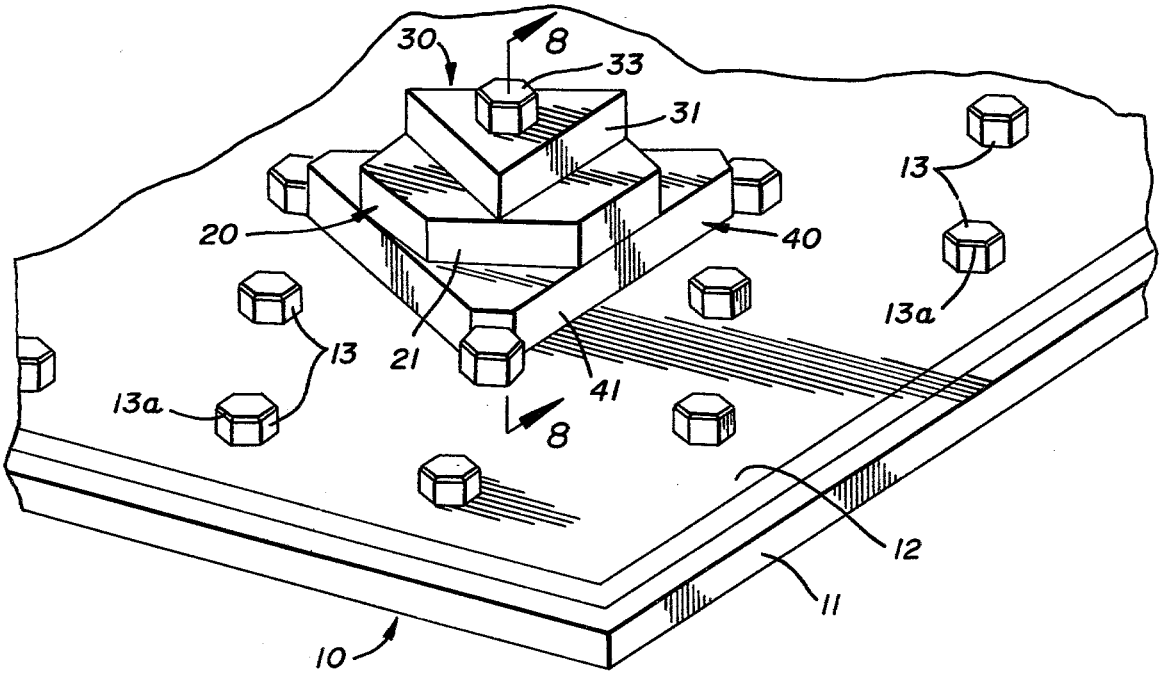
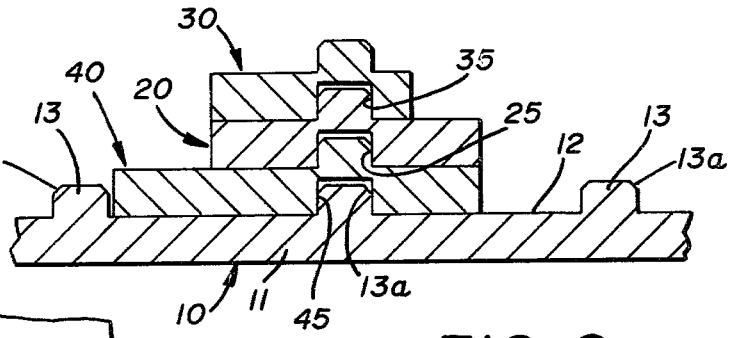
FIG. 8
FIG. 6
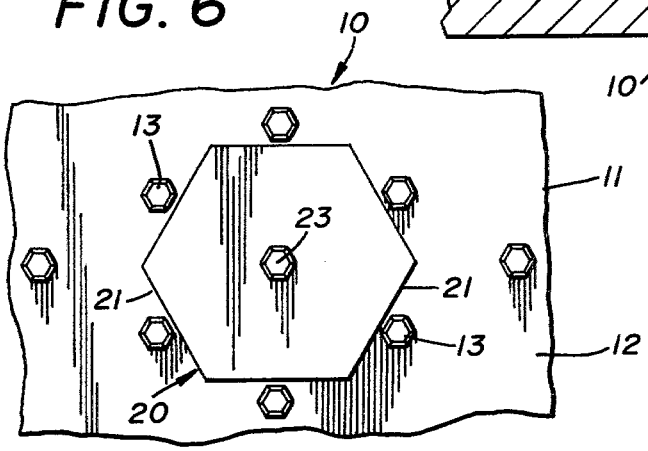

THREE DIMENSIONAL TOY

BACKGROUND OF THE INVENTION

This invention relates, in general, to toys or games which can be played by persons of all ages, but especially by young children, and relates in particular to a board type game having playing pieces which can be arranged on the board in varying patterns and three dimensional relationships.

PRIOR ART STATEMENT

Applicant is aware of a number of prior art patents relating to games capable of providing mosaics or designs.

For example, Konig U.S. Pat. No. 510,178 discloses a mosaic toy wherein a plate is provided with quadratic holes which taper conically downward and blocks are provided having a complemental taper and can be placed into the holes to provide a mosaic pattern.

Davis U.S. Pat. No. 2,611,193 relates to a mathematical training device using a base having vertically projecting pins and perforated discs which can be placed over the pins.

Keuls U.S. Pat. No. 2,759,295 is also a design forming toy having snap-in pieces and obtaining a three dimensional effect although not by stacking one piece on another.

Isreal U.S. Pat. No. 3,302,311 discloses the utilization of blocks having decorative surfaces which can be mounted on vertical shafts and rotated to obtain varying visual effects.

Malenge U.S. Pat. No. 3,579,859 discloses a game for making drawings of an ornamental nature wherein various sheets are overlaid in stacked relationship to form varying configurations.

Quercetti U.S. Pat. No. 3,748,752 is also a mosaic device having snap-in pieces but does not disclose any stacking arrangement.

Glassman U.S. Pat. No. 3,766,667 is a mathematical teaching device involving the utilization of a plurality of apertured blocks with the number of apertures corresponding to the numerical value of the block and a plurality of complemental pegs.

Kemnitzer U.S. Pat. No. 3,849,912 shows the utilization of varying geometric forms which can be stacked on long dowels projecting from a base and one upon the other to obtain varying effects. The dowels are arranged in 90° relationship to each other in quadratic fashion.

Hogan U.S. Pat. No. 4,051,261 is also of interest in showing a device for constructing geometric models.

None of these references, however, discloses Applicant's unique combination of a variety of geometrically shaped pieces capable of being mounted on a board having a plurality of projecting pegs arranged in 60° relationship and also capable of being color coded and mounted one upon the other for three dimensional effects. Furthermore, none of the references referred to above disclose the correlation between hexagonally or otherwise geometrically shaped pegs and their relationship to each other on the supporting board which will minimize the amount of movement and facilitate alignment in the instance of small children where this is particularly desirable.

SUMMARY OF THE INVENTION

Accordingly, then, it is an object of this invention to provide a three dimensional game having both educational and entertainment value and including the utilization of a board having projecting pegs of preferrably hexagonal cross-section and arranged in 60° relationship to each other as contrasted to a quadratic or 90° relationship.

This arrangement is a key feature of the games in that the planar configuration of the pieces is complemental to the angular relationship of the pegs.

It is a further object to provide a plurality of playing pieces having various planar geometrical configurations and having hexagonal recesses in their bottom surface and hexagonal projecting portions in their top surfaces so that they may be engaged with each other in stacked relationship and also may be engaged with the projecting pegs on the board.

Accordingly, production of an improved game having the above-noted characteristics becomes the principal object of this invention with other objects thereof becoming more apparent upon a reading of the following brief specification considered and interpreted in view of the accompanying drawings.

Of the drawings:

FIG. 1 is a perspective view of the board.

FIG. 2 is a perspective view of a small hexagonal playing piece.

FIG. 3 is a perspective view of a small triangular playing piece.

FIG. 4 is a perspective view of a "large" triangular playing piece.

FIG. 5 is a partial plane view showing the large triangular piece of FIG. 4 in place on the board.

FIG. 6 is a view similar to FIG. 5 showing a "large" hexagonal piece similar to that of FIG. 2 as placed on the board.

FIG. 7 is a partial perspective view showing a selected number of pieces arranged in stacked three dimensional relationship.

FIG. 8 is a sectional view taken along the line 8—8 of FIG. 7.

BRIEF DESCRIPTION OF THE PREFERRED EMBODIMENTS

Figure 9:
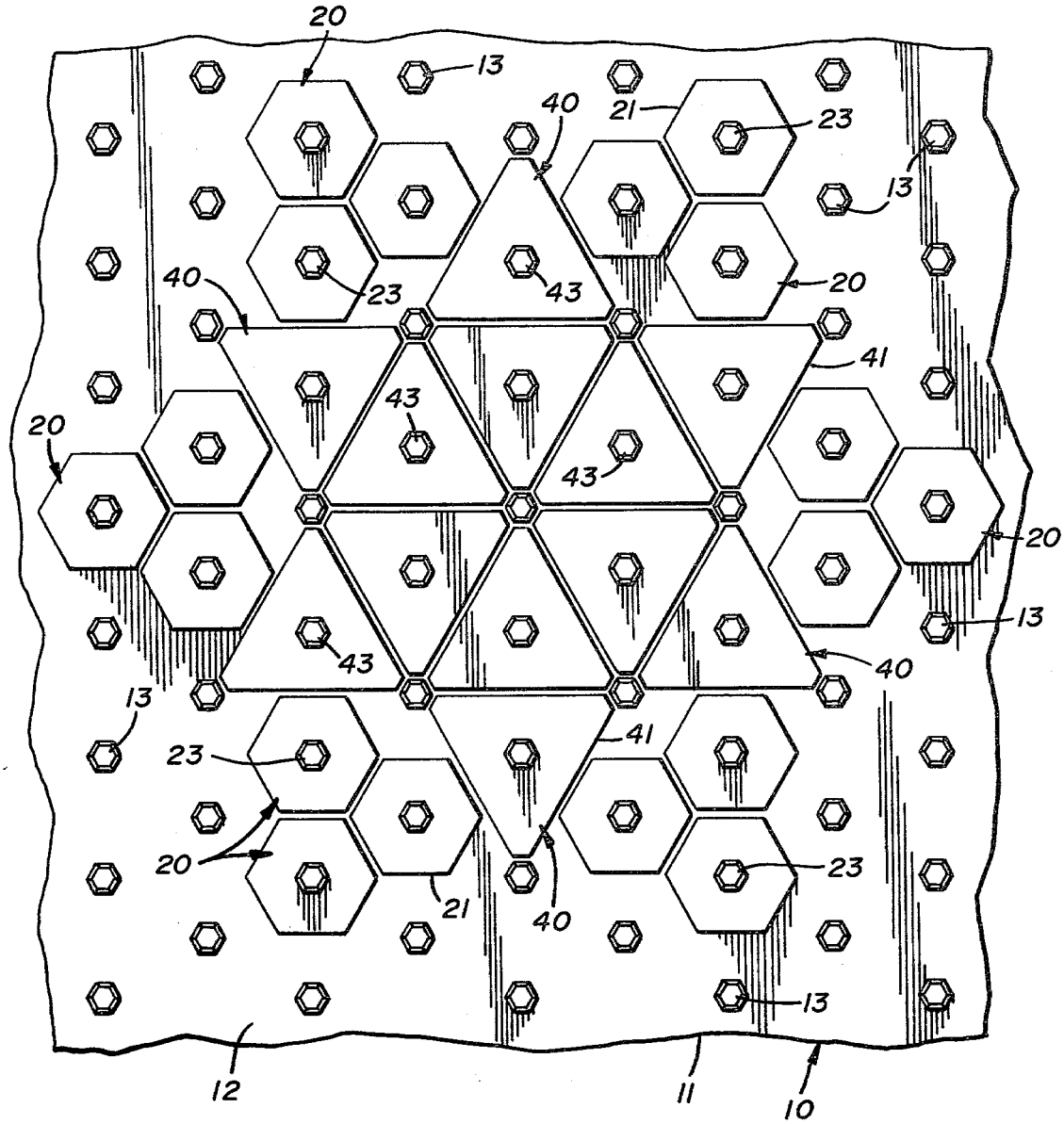
FIG. 9 is a plan view showing some typical two dimensional arrangements.

Referring first to FIG. 1, it will be noted that the board, generally indicated by the numeral 10, includes a base 11 having a top surface 12 and a plurality of upwardly projecting pegs 13,13 with chamfered or beveled top edges **13*a*, 13*a***.

These pegs preferably have a hexagonal crosssection and, as better shown in FIGS. 5 and 6, alternate rows of the pegs are offset and disposed in 60° relationship to each other. Thus, the pegs in each row are spaced equidistant from each other and the pegs in one row are disposed half the distance between pegs in the row. Stated otherwise, the "offset" between rows is one half the distance between pegs. In this way, a line drawn from the center points of any three pegs will form an equilateral triangle if two of the pegs lie in one row and the third lies on a line splitting the distance between the first two. Furthermore, all pegs are arranged so that side surfaces of adjacent pegs in adjacent rows are parallel so that they are all oriented in the same direction.

While the cross-sectional configuration of the pegs could vary from hexagonal to triangular, square, oblong, oval etc., it is believed that, in the preferred embodiment of the invention, the hexagonal configuration is most desirable because, as will become more apparent below, it is only necessary to rotate one of the playing pieces a maximum of 60° in order to obtain registry between the playing piece and peg. This is believed to be particularly advantageous with young children.

With regard to the playing pieces themselves, reference is first made to FIG. 2 wherein a standard playing piece 20 with the shape of a regular hexagon is provided having six equal side surfaces 21,21 and a top surface 22. This is a "small" hexagonal piece while FIG. 6 illustrates a "large" one. In each case, a hexagonally shaped pin 23 projects from top surface 22 and has chamfered, beveled or rounded top edges 24,24.

With reference to the bottom surface of the member 20, attention is called to FIG. 8 of the drawings wherein it will be noted that a centrally disposed aperture 25, which is also hexagonal in cross-section, is provided. This provision of complemental projecting hexagonal pin 23 and recess 25 permits the one piece 20 to be readily located on another and on the projecting pegs 13,13 of the playing board 10 as desired. It also should be noted that the recesses are slightly oversized with regard to pegs 13,13 and pins 23,23. This feature, together with the chamfer 24 facilitates location of the pieces.

FIG. 3 discloses a "small" triangular member 30 having the shape of an equilateral triangle having equal side walls 31,31 and a top surface 32. This piece also has a hexagonally shaped centrally located projecting pin 33 with chamfered or beveled top surfaces 34,34 and again, with reference to FIG. 8, it will be noted that an opposed hexagonal recess 35 is provided. Again, this permits the small triangle 30 to be placed on the pegs 13,13 of the board 10 and also would permit stacking with regard to the hexagonal piece 20 as is shown in FIGS. 7 and 8.

FIG. 4 illustrates a "large" triangle 40 having equal side walls 41,41 and with the points of the triangular piece being truncated as at **41*a*. This triangular piece also has a top surface 42 and a projecting hexagonal pin 43 with chamfered or beveled surfaces 44,44. Again, a recessed area in the bottom surface indicated at 45 in FIG. 8 is provided again for purposes of stacking and location on the playing board 10**.

The large triangle of FIG. 4 also as noted above has its ends truncated as at **41*a* and it will be noted from FIG. 5 of the drawings that this permits the large triangle to be placed so as to fall between three of the pegs 13,13 of the board. It should also be noted that technically piece 40**, with its truncated ends, is really a hexagon but it will be referred to herein as a "large" triangle for simplicity.

It should be mentioned that the pieces illustrated are, to some degree, exemplary only particularly with regard to size. For example, the "large" triangle 40, when placed on a peg 13 spans three rows of pegs (See FIG. 5) as does the "large" hexagonal piece 20 (See FIG. 6). However, it is believed apparent that larger or smaller pieces could also be used although the combination of shapes and sizes illustrated are believed adequate for demonstrating the basic concept.

FIG. 7 illustrates a stacking arrangement wherein a large triangle 40 has been placed on the board 10 following which a small hexagonal piece 20 has been stacked on top of it and a small triangle 30 on top of the hexagonal piece. It is believed readily apparent that a multitude of combinations can be achieved and the variety is virtually endless. Furthermore, it is apparent that there is virtually no limit to the height to which these pieces can be stacked or to the pattern in which they can be displayed on the board or on top of each other.

It is further contemplated that the pieces would come in a variety of colors thereby making it possible to provide a further wide range of possible patterns and visual effects.

It should be noted also that while the basic configurations illustrated here are hexagonal and triangular it is also believed that provision of a circular playing piece having, of course, a projecting hexagonal pin and a hexagonal recess would also enhance the game.

Furthermore, it is possible that other shapes of playing pieces could be used such as a rhomboid or a star, for example. However, the preferred embodiment of the invention is believed to involve the basic hexagonal configuration, the two triangular members and a circular member. Simplicity, ease of use and variety of patterns available with these basic playing pieces are believed adequate to provide a suitably large variety of patterns and designs.

There are no true rules involved with use of the instant invention and the designs, patterns, configurations are left essentially to the imagination of the player.

While a full and complete description of the invention has been set forth in accordance with the dictates of the Patent Statutes it should be understood that modifications can be resorted to without departing from the spirit hereof or the scope of the appended claims.

Thus, for example, no specific colors have been indicated in the drawings because the variety of colors is limited only by the color spectrum.

Furthermore, while no dimensions have been shown, it is believed desirable that the playing pieces such as 20, 30 and 40 be of sufficient thickness so as to register with the pegs. Also the projecting height of the pins on the playing pieces such as 23,33 and 43 have not been specified but reference to FIG. 8 of the drawings will show that they are slightly short of the depth dimension of the recesses 25, 35 and 45. They also should be of sufficient height to enable them to be grasped readily so that the pieces can be manipulated with ease.

Furthermore, no particular material has been described or specified herein although a suitably rigid, durable material would be desirable.

What is claimed is:

1. A design toy, comprising;

(A) a generally planar board:

(B) a plurality of registry pegs (1) projecting from one face of said board and (2) having a hexagonal cross-section;

(C) a plurality of playing pieces each having (1) a single recess opening into one surface and having a hexagonal cross-section and (2) a single pin projecting from an opposed surface and having a hexagonal cross-section (3) said playing pieces having a variety of planar configurations including hexagonal, triangular and circular;

(4) at least some of said triangular pieces have the points at the corners thereof truncated whereby they will not interfere with said pegs of said board;

(D) said pegs are disposed in 60° relationship to each other so that a line interconnecting the mid-points of any three pegs in more than one row forms an equilateral triangle where two pegs lie in one row and the third lies on a line splitting the distance between the first two;

(E) said pegs and said pins having a reduced cross section adjacent their distal ends; and (F) said playing pieces have different colors.

2. The toy of claim 1 wherein said pegs are disposed so that one face of each said peg in one row lies in a plane parallel to the plane of one face of each said peg in the next adjacent row.

3. The toy of claim 1 wherein at least some of said playing pieces are sized so that their longest dimension is less than the distance between the midpoint of adjacent rows of said pegs.

* * * * *